US012203266B2

(12) United States Patent
Wang et al.

(10) Patent No.: US 12,203,266 B2
(45) Date of Patent: Jan. 21, 2025

(54) CONSTRUCTION COMBINATION WITH ACOUSTIC ABSORBING DEVICE

(71) Applicant: Wiswong Technology Corporation, Kaohsiung (TW)

(72) Inventors: Hong Jen Wang, Kaohsiung (TW); Yu Ming Wang, Kaohsiung (TW); Kai I Wang, Kaohsiung (TW)

(73) Assignee: WISWONG TECHNOLGOY CORPORATION, Kaohsiung (TW)

( * ) Notice: Subject to any disclaimer, the term of this patent is extended or adjusted under 35 U.S.C. 154(b) by 46 days.

(21) Appl. No.: 18/061,148

(22) Filed: Dec. 2, 2022

(65) Prior Publication Data

US 2024/0183150 A1 Jun. 6, 2024

(51) Int. Cl.

| | |
|---|---|
| ***E04B 1/82*** | (2006.01) |
| ***E04B 1/84*** | (2006.01) |
| ***E04B 1/99*** | (2006.01) |

(52) U.S. Cl.

CPC ..... *E04B 1/8209* (2013.01)

(58) Field of Classification Search

CPC . E04B 1/8209; E04B 1/99; E04B 1/84; E04B 1/82; E04B 2001/8263; E04B 2001/8428; E04B 2001/8485; E04B 2001/8254; F01N 1/023

See application file for complete search history.

(56) References Cited

U.S. PATENT DOCUMENTS

| | | | | |
|---|---|---|---|---|
| 3,275,101 | A * | 9/1966 | Davis, Jr. | E04C 2/044 181/285 |
| 3,656,576 | A * | 4/1972 | Gubela | E01F 8/007 181/210 |
| 3,846,949 | A | 11/1974 | Okawa | |
| 3,866,001 | A * | 2/1975 | Kleinschmidt | E04B 1/8404 52/145 |
| 4,071,989 | A * | 2/1978 | Warren | E04C 1/41 52/145 |
| 4,094,380 | A * | 6/1978 | Kobayashi | E04B 1/8404 181/290 |
| 4,562,901 | A * | 1/1986 | Junger | E04B 1/8404 181/288 |
| 4,600,078 | A * | 7/1986 | Wirt | G10K 11/172 181/290 |
| 5,004,070 | A * | 4/1991 | Wang | E04B 1/86 181/292 |

(Continued)

FOREIGN PATENT DOCUMENTS

| | | | | |
|---|---|---|---|---|
| FR | 2700179 A1 * | 7/1994 | | E01F 8/0076 |
| KR | 20160066883 A * | 6/2016 | | |

*Primary Examiner* — Edgardo San Martin

(74) *Attorney, Agent, or Firm* — FISHERBROYLES, LLP; Roger L. Browdy; Ronni S. Jillions

(57) ABSTRACT

A construction combination includes a construction member, and an acoustic absorbing device engaged in the construction member for absorbing acoustic sounds. The acoustic absorbing device includes a housing engaged in the construction member, and a casing engaged in the housing. The housing includes one or more couplers, and the casing includes one or more connectors for engaging with the couplers and for anchoring the casing in the housing. A sound absorbing member is engaged in the casing, and the sound absorbing member includes an anchor for engaging with the casing and for anchoring the sound absorbing member in the casing.

5 Claims, 5 Drawing Sheets

(56) References Cited

U.S. PATENT DOCUMENTS

| | | | | | |
|---|---|---|---|---|---|
| 5,185,504 | A * | 2/1993 | Jen | E04B 1/86 | 181/292 |
| 5,457,291 | A * | 10/1995 | Richardson | G10K 11/172 | 181/294 |
| 5,491,310 | A | 2/1996 | Jen | | |
| 6,007,890 | A * | 12/1999 | DeBlander | E04B 1/86 | 181/290 |
| 6,021,612 | A * | 2/2000 | Dunn | G10K 11/172 | 181/290 |
| 6,457,554 | B1 | 10/2002 | Wang | | |
| 6,568,135 | B1 * | 5/2003 | Yokoyama | E01F 8/0094 | 181/290 |
| 7,451,855 | B2 | 11/2008 | Wang | | |
| 9,068,345 | B2 * | 6/2015 | Ichihashi | F02C 7/045 | |
| 9,330,651 | B1 | 5/2016 | Wang | | |
| 9,818,393 | B2 * | 11/2017 | Lagarrigue | G10K 11/172 | |
| 10,783,869 | B2 * | 9/2020 | Alstad | G10K 11/16 | |
| 10,808,399 | B2 * | 10/2020 | Alstad | E04B 2/7409 | |
| 11,455,978 | B2 * | 9/2022 | Tschiersch | E01F 8/0029 | |
| 2012/0247867 | A1 * | 10/2012 | Yang | E04B 1/86 | 181/211 |
| 2018/0174566 | A1 * | 6/2018 | Copley | G10K 11/161 | |
| 2019/0249580 | A1 * | 8/2019 | Nguyen Hung | F02M 35/1255 | |

* cited by examiner

CONSTRUCTION COMBINATION WITH ACOUSTIC ABSORBING DEVICE

BACKGROUND OF THE INVENTION

1. Field of the Invention

The present invention relates to a construction combination, and more particularly to a construction combination including an acoustic absorbing device disposed or engaged in a construction member for suitably absorbing acoustic sounds or the like.

2. Description of the Prior Art

Various kinds of typical house buildings, roadways, bridges, or the like comprise one or more partition or wall or construction members. However, normally, the partition or wall or construction members have no acoustic absorbing devices disposed or engaged therein, and may not be used for absorbing the sounds or noises and for preventing the sounds or noises from annoying the residents or the like.

Various kinds of typical sound insulating blocks or acoustic boards have been developed and provided for sound or noise absorbing purposes.

For example, U.S. Pat. No. 3,846,949 to Okawa, U.S. Pat. No. 5,491,310 to Jen, U.S. Pat. No. 6,457,554 to Wang, U.S. Pat. No. 7,451,855 to Wang, and U.S. Pat. No. 9,330,651 B1 to Wang disclose several of the typical sound insulating blocks or acoustic boards each comprising a specially shaped or configured sound absorbing plate fixed inside a cover which is then tightly closed in a block for sound or noise absorbing purposes, for allowing the typical sound insulating blocks to be stacked together to form a sound insulating wall.

However, the typical sound insulating blocks or acoustic boards may not be attached or engaged into the house buildings, roadways, bridges, or the like.

The present invention has arisen to mitigate and/or obviate the afore-described disadvantages of the conventional construction combinations.

SUMMARY OF THE INVENTION

The primary objective of the present invention is to provide a construction combination including an acoustic absorbing device attached or engaged in a construction member for suitably absorbing acoustic sounds or the like.

In accordance with one aspect of the invention, there is provided a construction combination comprising a construction member, and an acoustic absorbing device engaged in the construction member for absorbing acoustic sounds.

The acoustic absorbing device includes a housing engaged in the construction member for absorbing acoustic sounds. The acoustic absorbing device includes a casing engaged in the housing.

The housing includes a chamber formed in the housing, and at least one coupler extended in the chamber of the housing, and the casing includes at least one connector for engaging with the coupler of the housing and for anchoring the casing in the chamber of the housing.

The casing includes a compartment formed in the casing, and the acoustic absorbing device includes a sound absorbing member engaged in the compartment of the casing. The casing includes a slot formed in the casing and communicating with the compartment of the casing, and the sound absorbing member includes an anchor for engaging with the slot of the casing and for anchoring the sound absorbing member in the compartment of the casing.

The casing includes at least one column extended in the compartment of the casing. The acoustic absorbing device includes a cover attached to one end portion of the housing. The acoustic absorbing device includes a cap attached to one end portion of the housing. The acoustic absorbing device includes a tubing element connected to the cap.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
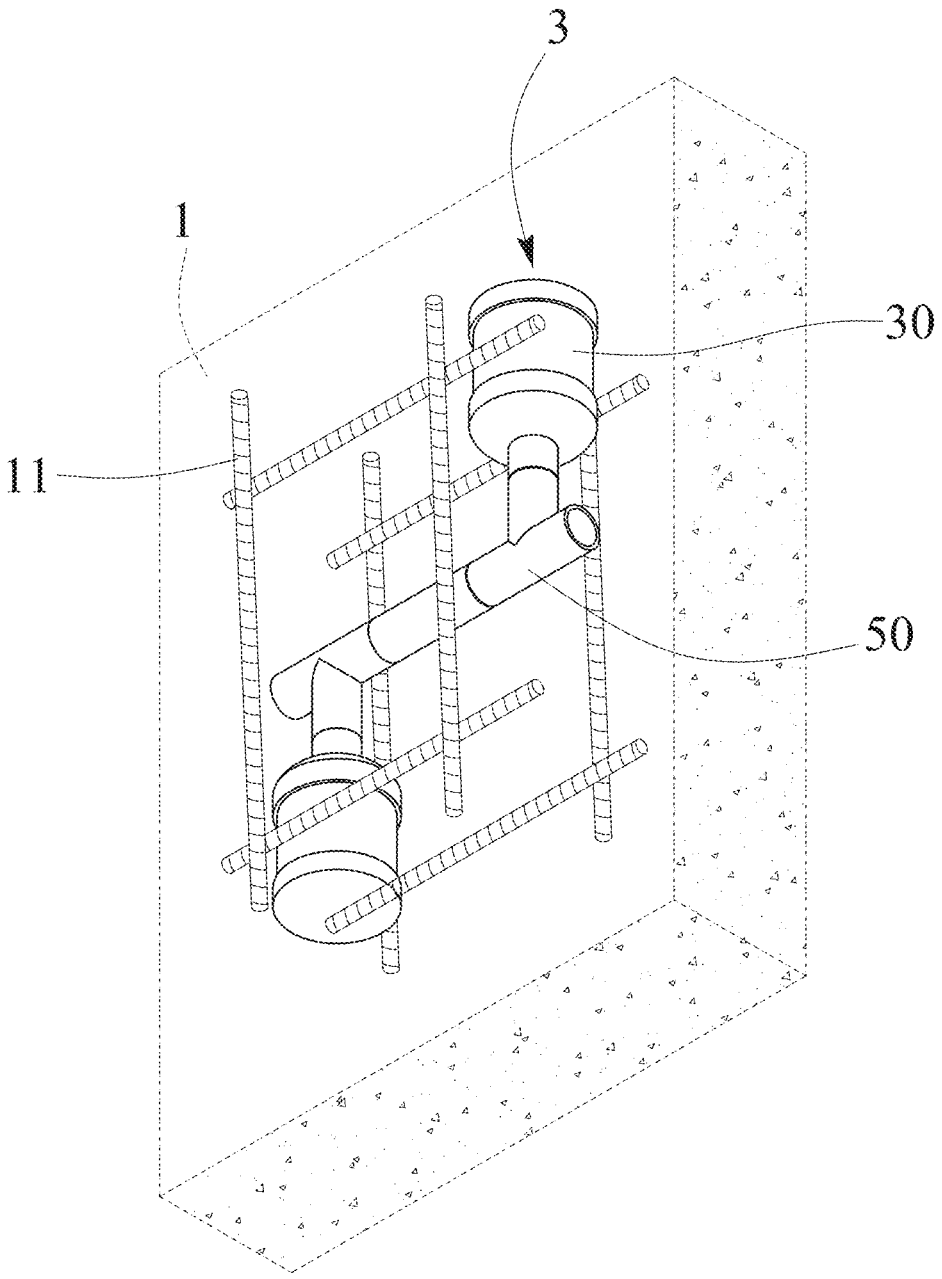
FIG. 1 is a partial perspective view of a construction combination in accordance with the present invention with an acoustic absorbing device disposed or engaged therein.

Referring to the drawings, and initially to FIGS. 1-4, a construction combination in accordance with the present invention comprises a partition or wall or construction member 1 including a concrete, rebar, fixture or steel frame 11 disposed or engaged therein, and one or more acoustic absorbing devices 3 disposed or engaged therein for suitably absorbing acoustic sounds or the like, and one or more couples or connector tubing elements 50 disposed or engaged therein for connecting or coupling the acoustic absorbing devices 3 together.

As shown in FIGS. 1-6, the acoustic absorbing device 3 includes an outer housing 30 having a cylindrical shape or structure or configuration, and the housing 30 includes a compartment or chamber 31 formed therein, and one or more (such as four) posts or couplers 32 extended in the chamber 31 of the housing 30 and preferably equally spaced or separated from each other, and each having a cylindrical shape or structure or configuration. A cover 33 may be attached or engaged onto one or first end portion of the housing 30, and another cover or cap 34 may be attached or engaged onto the other or second end portion of the housing 30 for enclosing the chamber 31 of the housing 30. The tubing elements 50 are connected or coupled to the caps 34 for connecting or coupling or communicating the chambers 31 of the housings 30 with each other.

The housing 30 further includes another housing or casing 40 disposed or engaged in the chamber 31 of the housing 30, and having one or more (such as four) tracks or rails or connectors 41 formed or provided on the outer peripheral portion of the casing 40 for engaging with the couplers 32 of the housing 30, and for suitably connecting or coupling or anchoring or retaining or positioning the casing 40 in the chamber 31 of the housing 30. The casings 40 each include a chamber or compartment 42 formed therein, and one or more notches or slots 43 formed therein and communicating with the compartment 42 of the casing 40. It is preferable, but not necessary that the casing 40 includes a number of rods or posts or columns 44 extended in the compartment 42 thereof (FIG. 6) for interfering the sound or noise entered or transmitted into the compartment 42 of the casing 40 and for absorbing the sound or noise.

The acoustic absorbing device 3 further includes a hollow sound absorbing barrel or member 45 disposed or engaged into the compartment 42 of the casing 40, and the sound absorbing member 45 includes one or more catches or anchors 46 formed or provided therein for engaging with the slots 43 of the casing 40 and for anchoring or retaining or positioning the sound absorbing member 45 in the compartment 42 of the casing 40 and for further absorbing the sound or noise.

Figure 2:
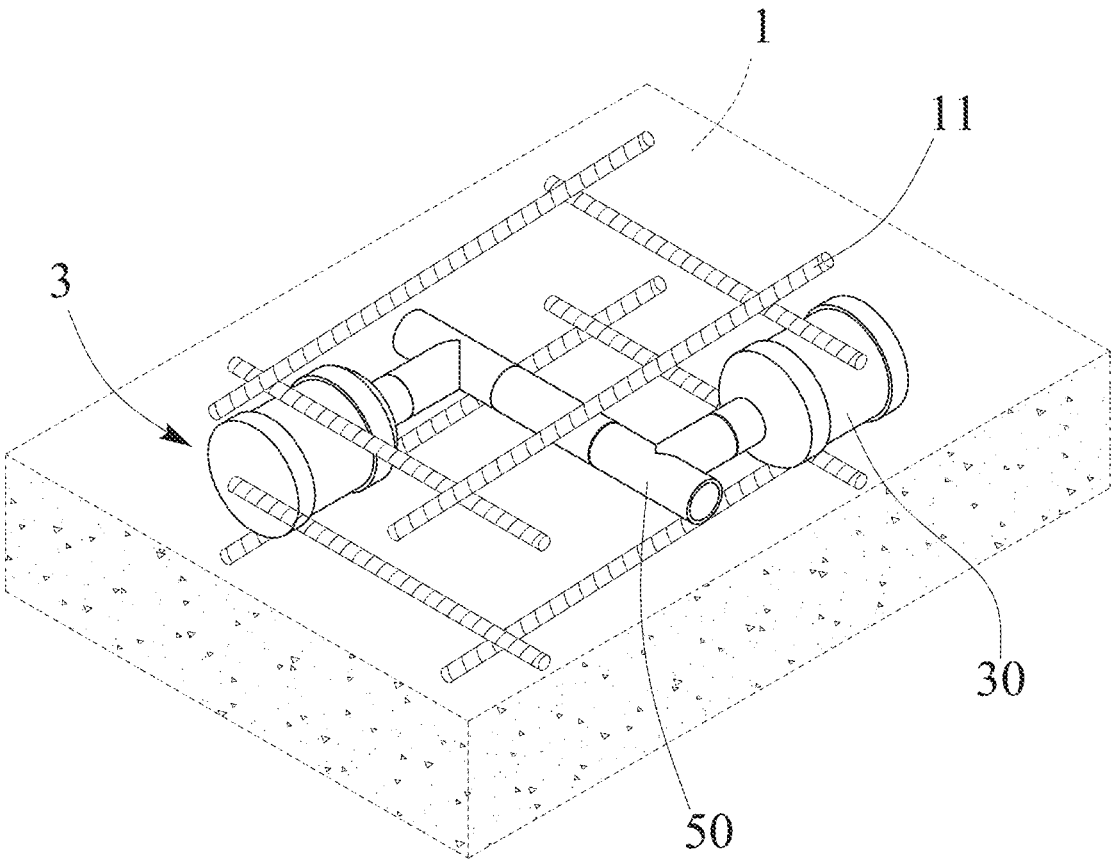
FIG. 2 is another partial perspective view of the construction combination as seen from a view or direction different from that shown in FIG. 1.
Figure 3:
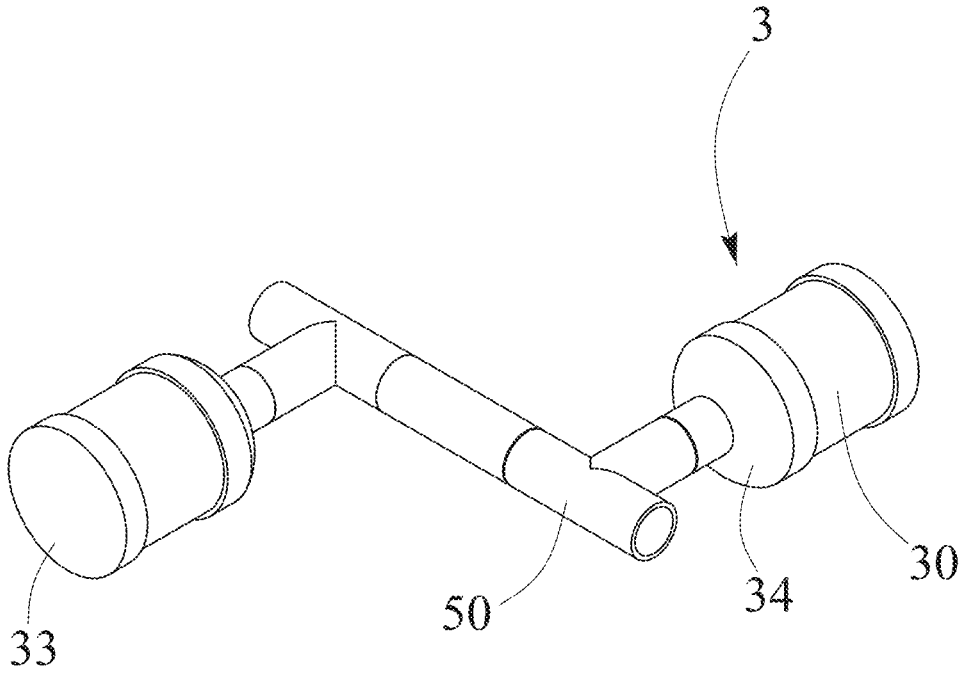
FIG. 3 is a partial perspective view of the acoustic absorbing device.
Figure 4:
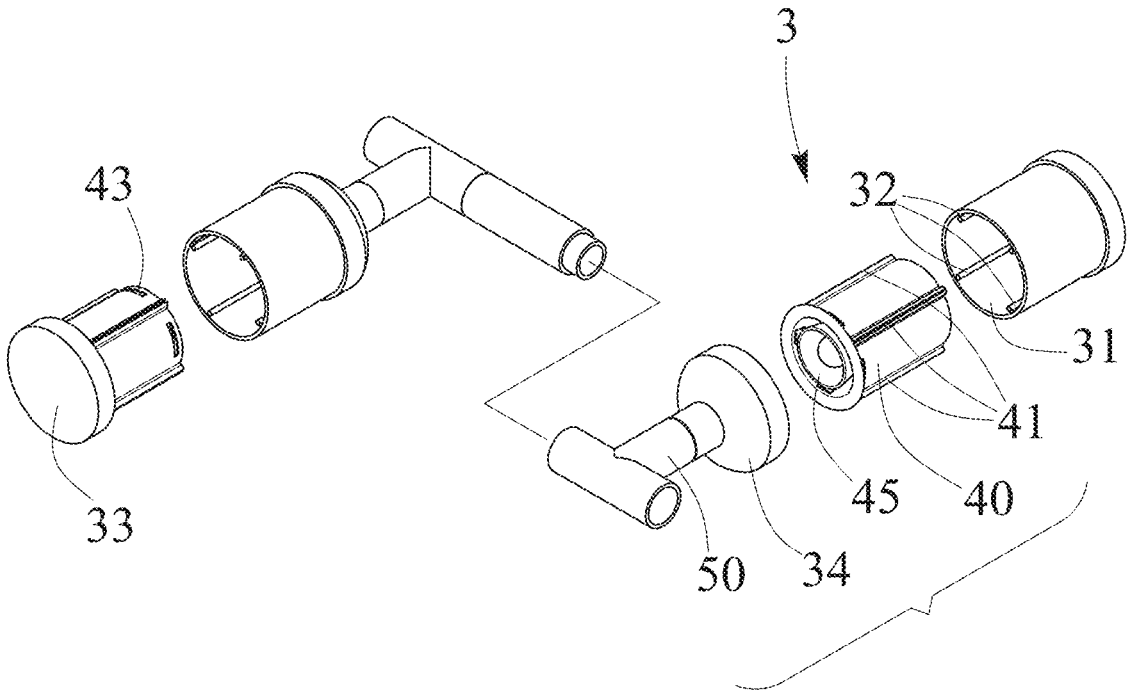
FIG. 4 is a partial exploded view of the acoustic absorbing device.
Figure 5:
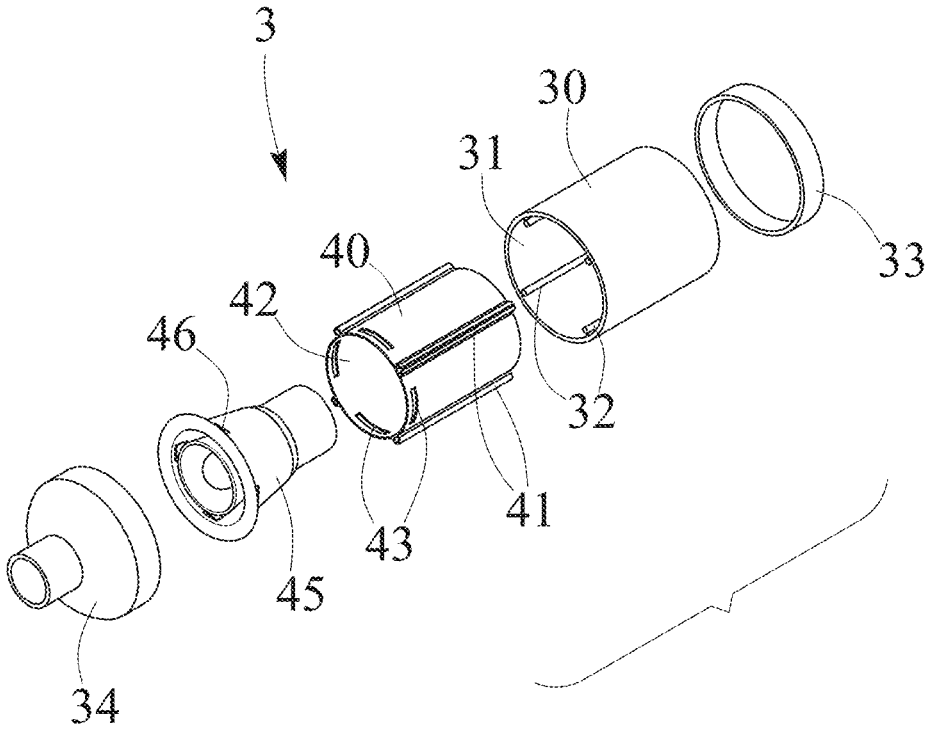
FIG. 5 is another partial exploded view of the acoustic absorbing device.
Figure 6:
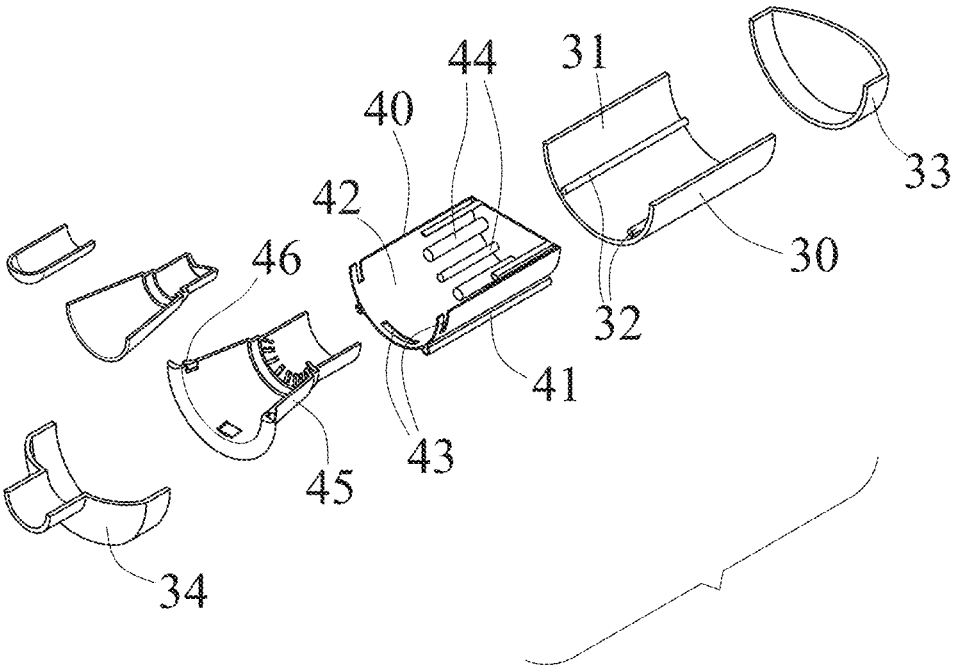
FIG. 6 is a further partial exploded view of the acoustic absorbing device.
Figure 7:
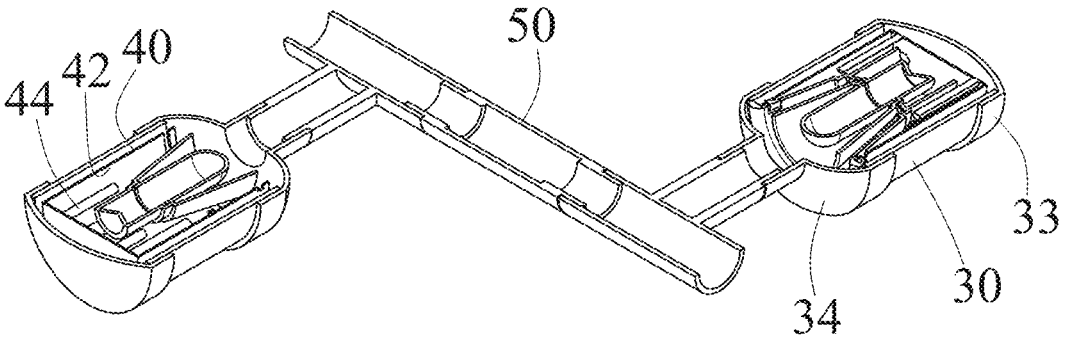
FIG. 7 is a further partial perspective view of the acoustic absorbing device, in which a portion of the acoustic absorbing device has been cut off for showing the inner structure of the acoustic absorbing device.

In operation, as shown in FIGS. 1 and 2, the housings 30 of the acoustic absorbing devices 3 are disposed or engaged into the construction member 1, and/or disposed or engaged in the steel frame 11 for absorbing the sound or noise that may be entered or transmitted into the partition or wall or construction member 1.

Accordingly, the construction combination in accordance with the present invention includes a construction member and an acoustic absorbing device attached or engaged in the construction member for suitably absorbing acoustic sounds or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A construction combination comprising:

a construction member, and an acoustic absorbing device engaged in said construction member for absorbing acoustic sounds, said acoustic absorbing device including a housing engaged in said construction member for absorbing acoustic sounds, said housing include a chamber defined in said housing, at least one coupler extended in said chamber of said housing, a casing engaged in said housing, said casing including at least one connector for engaging with said at least one coupler of said housing and for anchoring said casing in said chamber of said housing, a cap attached to one end portion of said housing, and a tubing element connected to said cap.

2. The construction combination as claimed in claim 1, wherein said casing includes a compartment formed in said casing, and said acoustic absorbing device includes a sound absorbing member engaged in said compartment of said casing.

3. The construction combination as claimed in claim 2, wherein said casing includes a slot formed in said casing and communicating with said compartment of said casing, and said sound absorbing member includes an anchor for engaging with said slot of said casing and for anchoring said sound absorbing member in said compartment of said casing.

4. The construction combination as claimed in claim 2, wherein said casing includes at least one column extended in said compartment of said casing.

5. The construction combination as claimed in claim 1, wherein said acoustic absorbing device includes a cover attached to said housing.

* * * * *